United States Patent [19]

Madgavkar

[11] Patent Number: 4,861,723

[45] Date of Patent: Aug. 29, 1989

[54] MICROBIOLOGICAL DESULFURIZATION OF COAL AND COAL WATER ADMIXTURE TO PROVIDE A DESULFURIZED FUEL

[75] Inventor: Ajay M. Madgavkar, Katy, Tex.

[73] Assignee: Shell Oil Company, Houston, Tex.

[21] Appl. No.: 941,666

[22] Filed: Dec. 15, 1986

[51] Int. Cl.[4] ..... C10L 10/00; C10L 1/00

[52] U.S. Cl. ..... 435/262; 44/51; 435/282

[58] Field of Search ..... 435/282, 262; 44/51

[56] References Cited

U.S. PATENT DOCUMENTS

| | | | |
|---|---|---|---|
| 4,206,288 | 6/1980 | Detz et al. | 435/282 |
| 4,455,150 | 6/1984 | Olen | 44/51 |
| 4,498,906 | 2/1985 | Scheffee | 44/51 |

*Primary Examiner*—Sam Rosen

*Attorney, Agent, or Firm*—Kimbley L. Muller

[57] ABSTRACT

The invention disclosed is for a combination of two processes to enable the clean burning of coal in a coal water mixture. First the coal is ground and then treated with a desulfurizing microorganism to desulfurize the coal. After separation the coal is formulated into a coal water admixture in requisite quantities of water to coal, and with proper inclusion of additives, is combusted in a suitable furnace equipped with a means to burn a coal-water mixture. The desulfurized coal, after treatment with a select microorganism, will contain less than 1.0 wt % pyritic (inorganic) sulfur, be low in ash content and be cleanly combustible to capture its latent heat values.

5 Claims, 2 Drawing Sheets

MICROBIOLOGICAL DESULFURIZATION OF COAL AND COAL WATER ADMIXTURE TO PROVIDE A DESULFURIZED FUEL

FIELD OF THE INVENTION

Acid rain is a major problem for the United States government and its ongoing relationships with other neighboring nations such as Canada. Sulfur oxides emitted from large coal burning power plants are converted, via rain, to sulfuric acid which is deposited in faraway lakes, forests and rivers. Coal of less than 1% by weight total sulfur is considered desirable in power generation plants. In fact, coal of greater than 1.5 weight percent total sulfur is considered to result in emissions of sulfur which are not tolerable by the environment.

With the depletion of petroleum reserves, industry and municipalities will eventually resort to coal as the principal energy source, especially if coal can be economically burned via a non-air polluting technique. Coal reserves of low sulfur are plentiful in the United States but they are not readily available to many of the East Coast power generation plants, which consume a majority of the coal. As a corollary, the coal which is present in the East Coast areas has a high pyritic sulfur form, such as iron pyrite.

Power plants that have the capability to burn both oil and coal can easily be adopted to burn a coal water slurry. Some coal cleaning technology that can produce coal particles suitable for a coal water slurry system include froth flotation, agglomeration and electrostatic separation. Coal water admixtures represent a safe supply of particulate fuel for the United States, which is also easily accessible. Coal water slurries necessitate minimal equipment to combust the coal for its latent properties of combustibility in comparison to the conversion of a coal to oil conversion or an oil to coal conversion. The coal water slurry may be delivered to a power plant by an easy and economical means such as by barge or through an oil slurry pipeline.

A completely integrated process for a coal water slurry system involves grinding of the coal usually in an aqueous media. Where the coal particles are not to be utilized in a coal water mixture they must be dried in order to combust the coal. This has been found to be not necessary when utilizing a coal water mixture. The instant invention combines coal water admixture technology with microbial desulfurization of the coal particles during their preparation from pulverization to coal water admixture. Desulfurization takes place at a time either during or after grinding but before the coal water admixture is prepared for combustion.

BACKGROUND OF THE INVENTION

Microbial desulfurization of coal has been perfected as shown by such disclosures as U.S. Pat. No. 4,456,688, Dugan et al and the publications cited therein. This disclosure concerning the steps of microbial treatment is herein incorporated by reference in regard to how to treat a sample of coal to desulfurize same with a mircoorganism. Living bacteria or microorganisms act as oxidation catalyst to promote the oxidation of insoluble metallic sulfide to soluble sulfate which is then transferred to an aqueous phase thereby extracting same from the solid particles of coal. In this manner, microbiological treatment of a ground coal will reduce sulfur content to a tolerable environmental level. Such microorganisms have been mixed with acid tolerant heterotrophs to advantageously desulfurize coal as taught in Dugan et al. The microorganisms exemplified by Dugan et al are acid tolerant Thiobacilli. These include T.thiooxidans, T.ferrooxidans, T.acidophilus and T.denitrificans.

In European patent application 126,443 (application No. 84105629.4) microorganisms capable of reducing the sulfur content in coal are obtained by growing the microorganisms in soil enriched with sulfur compounds. Contact of the aqueous coal slurry with the produced microorganism provides a coal having reduced organic sulfur content. Illustrative of other processes wherein microorganisms chosen from an acidophilic groups have been utilized to desulfurize coal are exemplified by U.S. Pat. No. 2,829,964. Other processes which employ Thiobacillus ferroxidans are exemplified by U.S. Pat. Nos. 3,218,252, 3,266,889 and 3,305,353, all of the teachings of which are herein incorporated by reference. The microorganisms exemplified in European patent 126,443 were deposited with the American Type Culture Collection (ATCC) with an accession number ATCC39,327 and which can be utilized in the desulfurizing step of this invention. This disclosure thus provides a ready access to microorganisms which will reproduce themselves in situ at an economically attractive rate.

Microorganisms can be suitable for different types of coal. In U.S. Pat. No. 3,796,308, McIlhinney et al, a process is described for upgrading coal ores containing inorganic sulfides by action of bacteria from the group of Thiobacillus ferrobacillus in an aqueous slurry. It was determined that by allowing an oxidizing bacteria to act only on the surface of the ore or coal that there is an alteration of the inorganic metal compound (pyrite) to a hydrophilic form, which thereby accelerates mineral interface separation. This achieves more efficient pyrite liberation from the coal. The process essentially comprises wet grinding to aid release of fine particles of metal sulfides and subjecting an aqueous mixture containing the ground material to action of an inorganic sulfide oxidizing bacteria to render the surface of the solids hydrophilic. The beneficiated ores are substantially free of the sulfur impurities. Microorganisms that can be employed for coal ores containing organic sulfides include Australian patent 29,597/84 (AU 8429597) wherein a pure culture of mutant Pseudomonas is taught as being useful to remove organic sulfur compounds from coal. The ATCC number for these mutants is 39,381 and they are likewise feasible bacteria for use in this invention when it is desired to treat coals having sulfur compounds of organic origin.

This invention concerns the combination of any viable microorganism desulfurization of coal in combination with concoction of a coal-water mixture. A leader in the field of formulating coal water admixtures is Occidental Petroleum Corporation. One publication of this company teaches how to use and how to make particular coal water mixtures. This publication entitled "Coal-Water Mixture Technology" is attached and herein incorporated by reference to this application. In the June 27, 1983 edition of *Chemical Engineering* at page 14, disclosure is made of various coal-water slurries and their adaptation to certain power plants. All of the above references fail to suggest combination of microorganism desulfurization technology with coal water mixture to prepare coal particles having a sulfur content of less than 1% by weight for economic and clean coal combustion.

OBJECTS AND EMBODIMENTS

It is therefore an object of this invention to provide a combinative process whereby particulate coal substantially free of sulfur is combusted in a coal water mixture or admixture.

Another object of this invention is to provide a process whereby coal can be treated with a microorganism suitable to desulfurize the coal and then form a coal water admixture with recycle of a portion of the aqueous microorganism phase to the coal desulfurization area.

Another object of this invention is to provide a combinative coal desulfurization and coal water admixture process whereby coal is desulfurized during wet grinding in the presence of water and a microorganism to provide desulfurized coal particles which can be formulated into a suitable coal water admixture.

Yet another object of this invention is to provide, via microorganism treatment, a sulfur free precursor coal for preparation of a coal water admixture which can be formulated to a pipeline slurry for transmission to power plants.

One embodiment of this invention resides in a process for providing a desulfurized coal water admixture which comprises grinding said coal in a grinding means to form an aqueous slurry with said ground coal; passing said coal slurry to a microbial desulfurization zone to contact said coal slurry with a desulfurizing microorganism and to thereby produce a desulfurized coal slurry containing said desulfurized coal, water and removed sulfur compounds; passing said desulfurized coal slurry to a separation zone wherein said ground coal and water are separated to form a liquid phase comprising water, microorganism and sulfur compounds and a desulfurized coal containing water; passing said desulfurized ground coal and water to a coal water mixture zone wherein additives are added to said desulfurized ground coal and water and wherein said coal and said water are proportioned to provide a combustible coal water admixture; and combusting said coal water admixture in a combustion means suitable for combustion of said coal water admixture.

Another embodiment of this invention resides in a process for preparing or producing a desulfurized coal water fuel admixture which comprises grinding coal in the presence of water and a microorganism in a grinding means to form an aqueous coal slurry and to selectively oxidize and transfer sulfur contained in said coal from said coal to the aqueous phase of said slurry at grinding and conversion conditions; removing through a separation means one phase of said coal slurry from a second phase of said slurry, wherein one of said phases comprises solid particulate coal and a second of said phases comprises an aqueous phase containing said sulfur and said microorganism; and passing said ground coal and water to a coal water mixture zone wherein additives are added to said ground coal and water and wherein said coal and said water are proportioned to provide a combustible coal water admixture.

Another embodiment of this invention resides in a process for the combustion of desulfurized coal in a coal water admixture which comprises the sequential steps of wet grinding coal in a grinding means in the presence of water at grinding conditions to form an aqueous slurry of said ground coal particles; contacting said aqueous coal slurry with an aqueous solution of a desulfurizing microorganism to remove sulfur from said coal and transfer said sulfur to the aqueous phase of said slurry; separating said aqueous phase of said coal slurry, containing said removed sulfur, from said particulate coal particles in a separation zone to acquire at least two streams comprising (1) an aqueous stream containing said sulfur and said microorganism and (2) a solid particulate coal having water associated therewith; passing said solid particulate coal having water associated therewith, without substantial drying, to a coal-water admixture preparation zone wherein coal-water additives are added to said coal water admixture and wherein said coal-water admixture is proportioned to a predetermined coal and water content; passing said prepared coal water admixture to a combustion means wherein said coal is combusted; treating said aqueous stream containing said sulfur and microorganism in a sulfur removal zone to remove said sulfur; and recycling said treated stream to said contact with said coal as a portion of said aqueous solution used in desulfurizing the coal.

BRIEF DESCRIPTION OF INVENTION

This invention relates to a combination of (1) microbial desulfurization of a ground coal to a reduced sulfur content and thereafter the formation of two phases, wherein one phase containing particulate coal, of lower sulfur content, is separated from an aqueous phase along with residual water and (2) said desulfurized coal is compounded to a coal water admixture in the presence of various additives to provide a desulfurized coal water admixture for eventual combustion.

DETAILED DESCRIPTION OF INVENTION

In most microbial coal desulfurization processes the desulfurized coal must be separated from the aqueous medium containing the bacteria to enable excising the sulfur compounds and aqueous solution and to form a recycle stream comprising an aqueous bacteria solution for recycle to the desulfurization step. The recovered coal is usually then thermally dried before using same in a combustion application. This results in inefficient use of energy in drying the coal. Additionally, extra equipment is needed as a capital penalty for this type of coal combustion. In order to eliminate this process disadvantage, a combination processing scheme has been developed wherein a combination process comprises: (1) microbial coal desulfurization and (2) coal water admixture for combustion of the coal. Another advantage of this invention is that in the coal grinding step, which may be wet as well as dry, although the former is preferred, the coal can be ground as fine as either process requires since finer grinding of the coal is beneficial to both processes. This invention is a unique blend of microbial desulfurization and coal water admixture technologies to arrive at an overall beneficial combined process for clean combustion of the coal.

MICROBIAL DESULFURIZATION OF THE COAL

The coal used in this invention is preferably bituminous coal having pyritic (inorganic) sulfur as an unwanted impurity. The coal is mined and transmitted to the front end of this process and treated in various screens or sieves so as to formulate a consistent size lump of coal for grinding. The grinding of the coal may take place in any grinding means which acts to pulverize a substantial portion (averaging) of the coal to a fine particle size of from about 30 microns to about 350 microns, and preferably a finer size of from about 70 microns to about 150 microns. This grinding can be done in a dry environment, however, it is preferred that a wet environment be adapted during grinding. In this manner the grinding mechanism utilizes less energy and produces better shear resistant coal of specific size. The wet grinding of the coal is preferably performed in the presence of an aqueous solvent which forms a slurry of the ground coal. While it is conceivable that desulfurizing microorganism can be present during grinding of the coal, it is preferred that microbial desulfurization take place in a separate desulfurization zone. After grinding, the aqueous solution of coal and water is treated with an acidic material to modify or adjust the pH to stimulate the microorganism desulfurization technique. The coal slurry is formed by adding a quantity of water comprising from about 150 gallons of water to 900 gallons of water per ton of said ground coal. The coal slurry is passed to a microbial desulfurization zone wherein a separate stream of an aqueous solution of a microorganism selected for beneficial desulfurization of the coal is present and wherein the microorganism functions to desulfurize the coal. Any known desulfurizing microorganism can be utilized such as set forth in U.S. Pat. No. 4,456,688. In the presence of the select microorganism, pyrite will oxidize to a ferric iron, which in turn may also act as a catalyst for the desulfurization step. The specific types of microorganisms are exemplified by Thiobacilli including T. thiooxidans, T. ferrooxidans, T. acidophilus and T. denitrificans, or any species of microorganisms selected from the genera of *Pseudomonas, Alcaligenes, Bacillus, Desulfovibrio, Arthrobacter, Flavobacterium, Beijerinckia, Rhizobium* and *Acinetobacter*, etc.

The contact of the coal particulate slurry with the desulfurizing microorganism is made at contacting conditions including a temperature of from about 15° C. to about 90° C. and for a period of time sufficient to desulfurize the coal. This time usually encompasses from about 15 minutes to about 170 hours of contact. The temperature and time is strongly dependent on the type of coal and the microorganism. The contact of the coal particles with the microorganism results in a coal which contains less than two and preferably less than one weight percent sulfur.

After desulfurization, sulfur is transferred from the particulate solid material to the aqueous phase. The combined aqueous phase and coal particules are passed to a separation zone wherein separation occurs via the physical attributes of the solid and liquid phases. These two phases may be separated by centrifugation, filtration, decantation or any combination of these physical combination steps. The coal recovered from the separation means has from about 1 to about 15 weight percent water associated therewith. This water is either absorbed in the pores of the coal or alternatively is physically associated with the surface of the coal. The coal is not dried before passage to a coal water admixture zone.

In the coal water admixture preparation zone, a coal water mixture is prepared from the desulfurized coal. As it contains less than one weight percent sulfur and a micron size of not greater than 350 microns, it is readily convertible to a coal water admixture. This admixture is made by a pulverized coal and water composition having from 20 percent to 40 percent water and from 60 percent to 80 percent coal in particulate form. The coal water admixture may contain small amounts of additives necessary to enhance the combustion properties of the coal in regard to resistance to extended shear of the coal particles, to make the same pumpable through a slurry pipeline, to enhance the stability of the coal and to create a better combustible product.

The types of additives will depend on the nature of the utilization of the coal water admixture produced. One additive is a petroleum based surfactant such as polysulfones or polycarboxylates. The major function of the surfactant is to reduce the viscosity of the admixture in a dramatic fashion. The second major additive is a stabilizing agent which imparts ability of the solution to maintain its fluid type properties for a long time. This type of stabilizing agent is exemplified by xanthan gum, which is a bio-polymer. A third additive may also be added depending on the storage requirement of the coal water admixture. If the product is to be a stored for a period of less than 5 days, no additive is required but a small amount of biocide may be added to protect biodegradation of the stabilizing agent in the slurry. The biocide concentration is dependent upon the concentration of the stabilizing agent and the storage requirement. Finally, if necessary, a small amount of anti-foaming agent such as a silicone base is added to minimize the foaming tendency of the coal water admixture.

The coal water admixture is combusted in a combustion zone suitable for such an admixture. It is also feasible to transmit the coal water admixture via a slurry pipeline to a combustion means. The combustion means are well known to those of reasonable skill in the art and generally comprise specifically designed nozzles to optimize the combustion qualities of the coal water mixture.

The aqueous phase recovered from the separation zone contains microorganisms, water and sulfur. The sulfur is removed by separation according to the physical attributes of sulfur versus the water containing the microorganism. Once separation of the sulfur occurs, the water and microorganism can be recycled back to either the grinding step or the desulfurization step. It is quite possible that a good percentage of the microorganism has been eliminated or killed during the desulfurization step. If so, a new or regenerated microorganism is added to the recycle stream. It is also feasible to install regeneration treatment to the microorganism of the recycle stream to renovate the desulfurization activity and ability of the microorganism.

DETAILED DESCRIPTION OF THE DRAWING

Figure 1:
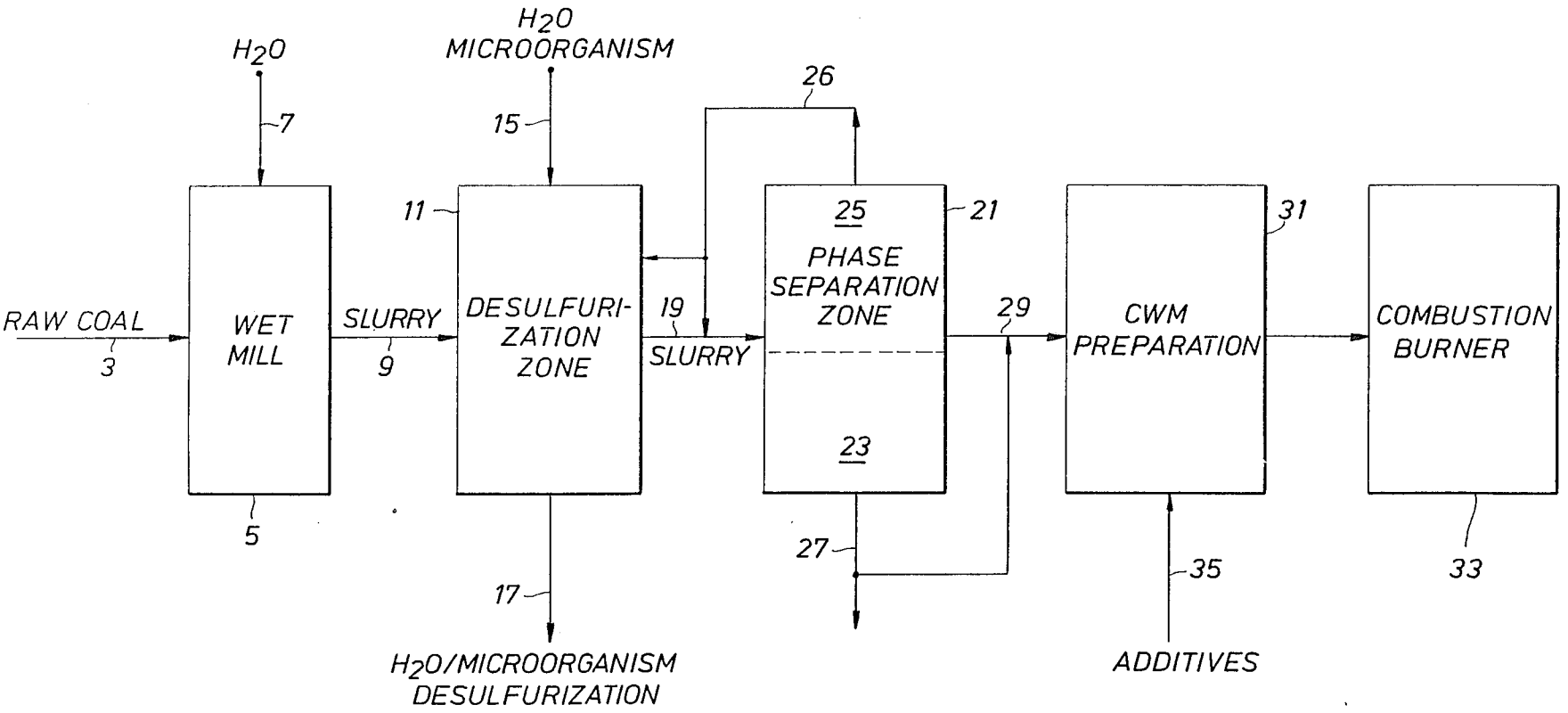
FIG. 1 is a schematic flow scheme of the preferred process of this invention.

In FIG. 1 a raw coal selected from anthracite, bituminous, subbituminous, mine tailings, fines, lignites, charcoal and the like are transmitted to the front end of the process in conduit 3. Grinding in a grinding mill such as a wet grinding mill transpires once the coal is transferred to grinding means 5. The coal is preferably sized before grinding. Water is added in conduit 7 to grinding mill 5 to form the basis of the wet grinding. At this point a slurry of small particulate coal having a micron size of not greater than 350 microns (for the major portion) and water is removed in conduit 9 from grinding mill 5 and passed to desulfurization reaction zone 11. Desulfurization zone 11 may be equipped with a recycle stream 26 for the continuous passage of water and regenerated desulfurizing microorganisms to the desulfurization zone. In the event that fresh water and fresh microorganisms are desired, the same can be added by means of conduits 15 and 13 with or without the recycle stream. Desulfurization occurs in desulfurization zone 11. A slip stream 17 may be removed containing water, the microorganism and the sulfur. A desulfurized coal slurry stream is removed in conduit 19 from desulfurization zone 11 having therein small particulate coal substantially free of sulfur (less than 1 wt %), water, sulfur ( removed from the coal and present in the aqueous phase) and microorganisms. This slurry is transmitted to phase separation zone 21 wherein two phases 23 and 25 are formed. Phase 23 comprises mainly small particulate coal with a residual amount of water therearound. Phase 25 comprises sulfur, water and the microorganism. A portion of phase 25 can be withdrawn and recycled to conduit 19 or reactor 11 by means of conduit 26. This stream may be treated in a manner or by a suitable procedure to renovate or reactivate the recycled microorganism and remove any renovate or reactivate the recycled microorganism and remove any sulfur before passage back to desulfurization zone 11. The solid particulate coal having a micron size of not greater than 350 microns is removed from phase separation zone 21 (phase 23) by means of conduit 27 and passed to coal water admixture zone 31 wherein a coal water admixture is prepared for burning in combustion means 33. Additives may be added in the coal water mixture zone by means of conduit 35. The above flow description will be exemplified in the following further illustrative embodiment as it relates to FIG. 2 which is not to be read as a limitation upon the claims of this invention.

ILLUSTRATIVE EMBODIMENT

Figure 2:
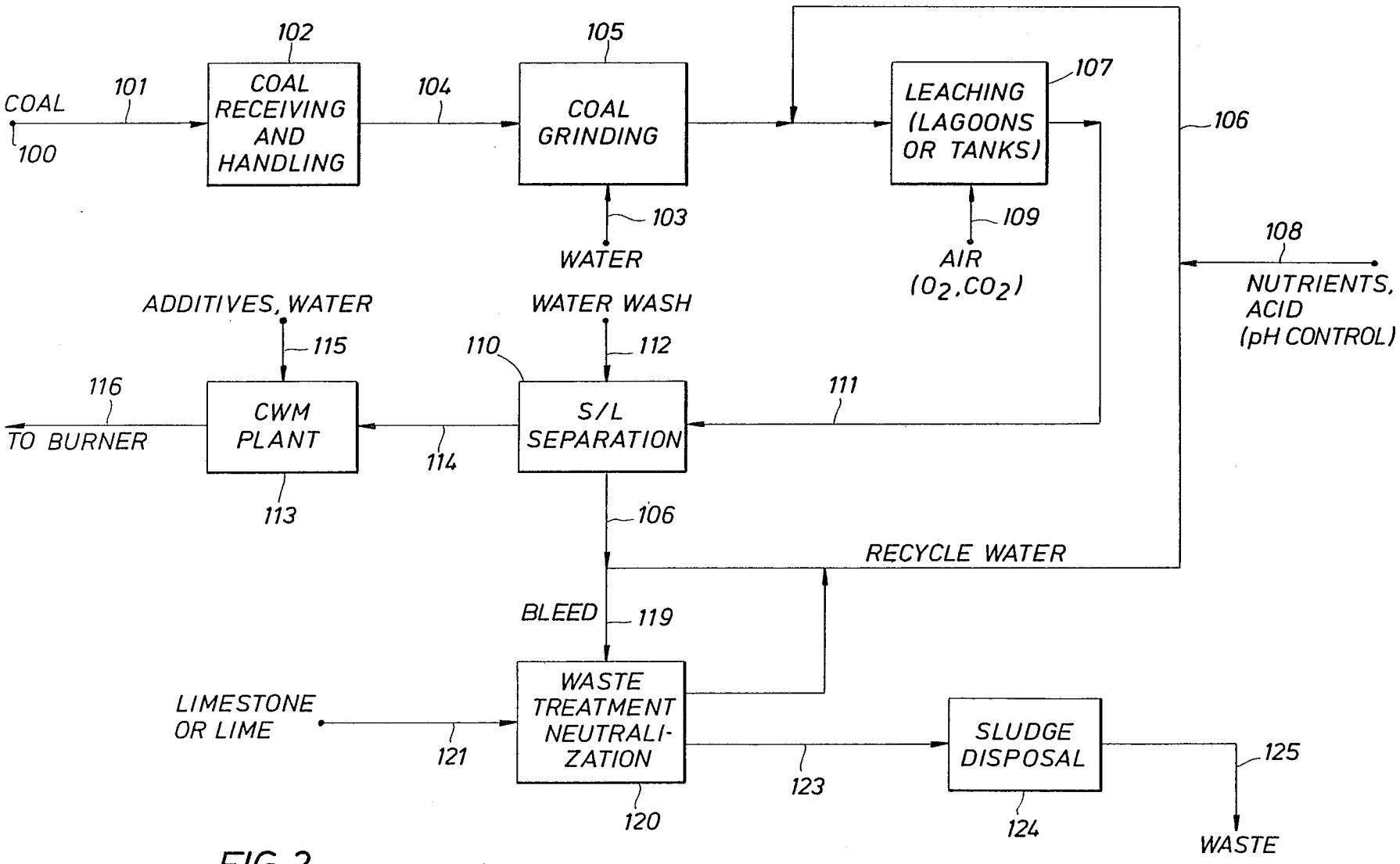
FIG. 2 is a schematic flow scheme commensurate with the illustrative embodiment which exemplifies this combinative invention.

In FIG. 2, raw coal is fed from coal storage 100, for example a coal bunker or a silo and via conduit 101, to grinding section 105 through receiving and handling section 102 and conduit 104. The coal's heating value is about 10,000 BTU/pound. The inorganic or pyritic sulfur content of the coal is about 2.7% by weight out of the 3.8% total, the residuum being organic sulfur.

Grinding section 105 consists of two separate coal grinding mills which operate in series with one another. The first mill is a hammer mill and the second is a ball mill. Coal is accurately metered with the help of a coal weighfeeder (not shown) into the hammer mill where it is ground dry (in air or in an inert gas such as nitrogen) to a fine particle size. The product coal from the hammer mill is then mixed with fresh water added by means of conduit 103 and fed to the ball mill where further size reduction of the coal particles takes place in the presence of water. This wet grinding is carried out with coal concentration in a slurry at approximately about 50 to 60% by wt. The coal concentration is kept as high as practical to reduce the size of the ball mill so as to minimize the capital cost of the process. The water added to the coal in the ball mill is close to neutral pH so as to minimize the corrosion of the ball in the ball mill. For this reason, recycle water (described later) is not fed to the ball mill. The coal is finally ground to a nominal product size of 70 to 80% by wt. passing 200 mesh.

The coal slurry from the ball mill is then mixed with a large quantity of water recycled from conduit 106 from the microbial coal desulfurization (MCD) process. The amount of water added is preferably enough to obtain approximately 20% by wt. coal in the final slurry. The slurry is then pumped to a leaching section (reactor) 107 which typically consists of large lagoons or tanks. The pH of the slurry is maintained at about 1.5 to 3 by adding sulfuric acid if necessary through conduits 106 and 108. The desulfurization reaction is carried out at a temperature between 70° to 90° F. by providing heat if required which is provided by steam coils (not shown) in the leaching section. The same coils may also be used to remove heat from the mixture if necessary in certain extreme situations. (This is accomplished by circulating cooling water through the coils instead of steam). The coal in the slurry is kept in a suspension with the help of agitators present in the reactors and also by bubbling air from the base of the reactor. The air also provides the oxygen and carbon dioxide needed for the reaction.

The microbes needed as catalysts for the reaction are present in the recycle water recyled in conduit 106. They include a mixture of autotropic acidophilic Thiobacilli and acid tolerant heterotrophic microorganisms which are derived from cultures originating in coal-bearing environments. Specifically, the Thiobacilli include *Thiobacillus ferrooxidans, Thiobacillus thiooxidans*, and *Thiobacillus acidophilus* and the heterotrophs include molds, yeasts and bacteria. These heterotrophic microorganisms act synergistically with the *Thiobacilli*. The inoculant is specific only to pyritic sulfur which is oxidized to sulfates while the organic sulfur is not affected at all. Nutrients for maintaining an adequate growth of the bacterial culture are added to the recycle water via conduit 108 if needed. (A more detailed description of the inoculant and various nutrients is given in aforementioned U.S. Pat. No. 4,456,688 to Dugan et al). Air or $CO_2$ can be added if desired through conduit 109.

The reaction typically takes place over a residence time of between three to five days for a coal slurry to attain about 90% reduction in pyritic sulfur. The product coal sulfur content is reduced along with pyritic sulfur. The ash content is reduced and the heating value of the coal is increased. The slurry is then pumped to a solid/liquid separation section 110 by conduit 111 of the microbial coal desulfurization (MCD) plant where the coal is separated from the majority of the water. Initially, the slurry is sent to a settling tank or pond where the coal settles to the bottom and the supernatent water is removed for recycle purposes. The coal is next washed with water added by means of conduit 112 to remove sulfates and bacteria adsorbed on its surface. Additional dewatering of the coal takes place in the final mechanical separation process which is chosen from centrifugation, hydrocyclone and vacuum filtration.

The desulfurized, clean product "wet" coal from the solid/liquid separation section contains anywhere from about 15% to 30% water and is passed to the coal water mixture (CWM) section 113 of the plant by means of conduit 114. The amount of water in this product coal is varied depending upon the final properties desired of the CWM product. In the CWM section, proper amounts of various additives and the required water are blended with the coal to produce a fluid type mixture added through conduit 115. The types of additives will depend on the nature of the utilization of the CWM produced but in all cases the total amount of additives added is less than 1% by wt. of the CWM product. Of this, about 0.5 to 0.7% by wt. is a petroleum based surfactant such as polysulfones or polycarboxylates. The major function of the surfactant is to reduce the viscosity in a dramatic fashion. Typically, the viscosity of the CWM will be less than 2500 centipoise at a shear rate of 110 reciprocal seconds. The second major additive is a stabilizing agent which imparts the suspension's the ability to maintain its fluid type properties over a longer period of time. The preferred type of stabilizing agent is xanthan gum which is a bio-polymer. The concentration of this additive is typically between 0.1 to 0.3% by wt. A third additive may or may not be added depending on the storage requirement of the CWM product. If the product is to be stored for a period of less than 5 days no additive is required but beyond that a small amount of biocide is added to protect biodegradation of the stabilizing agent in the slurry. The biocide concentration is between 0.05 to 0.2% by wt. and is dependent upon the concentration of the stabilizing agent and the storage requirement. Finally, if necessary, a small amount of anti-foaming agent such as a silicone base is added to minimize the foaming tendency of the CWM product. After formation of the desired CWM, the mixture is removed by means of conduit 116 and transferred to a burner for maximum clean combustion.

The sulfates in the water from the MCD process are removed in waste treatment section 120 via conduit 119. Bleed stream 119 adds the waste water from stream 106. Treatment section 120 consists of a lined pond where limestone ($CaCO_3$) is added through conduit 121 with the sulfate containing water. The sulfates are precipitated as $CaSO_4$, which is removed as a sludge in conduit 123, and are dried to about 30% water before being disposed of as a landfill material in sludge disposal section 124. The supernatent water from the waste treatment section is recycled back to the MCD process while sludge waste 125 is carefully disposed of.

I claim as my invention:

1. A process of the combustion of coal containing sulfur which comprises the sequential steps of:

(a) wet grinding said coal in a grinding means in the presence of water to a majority solid particulate size of about 30 microns to about 350 microns at grinding conditions to form an aqueous slurry of said ground coal particles;

(b) contacting said aqueous coal slurry with an aqueous solution of a desulfurizing microorganism to remove sulfur from said coal and transfer said sulfur to the aqueous phase of said slurry where said coal has a reduced level of inorganic sulfur equal to less than 0.1 wt %;

(c) separating said aqueous phase of said coal slurry, containing said removed sulfur, from said particulate coal particles in a separation zone to acquire at least two streams comprising (1) an aqueous steam containing said sulfur and said microorganism and (2) a solid particulate coal having water associated therewith;

(d) passing said solid particulate coal having water associated therewith, without substantial drying, to a coal-water admixture preparation zone wherein combustion-aid additives are added to said admixture and wherein said coal-water admixture is proportioned to a predetermined coal and water content for combustion;

(e) passing said prepared coal water admixture of step (d) to a combustion means wherein said coal water admixture is combusted;

(f) treating said aqueous stream containing said sulfur and microorganism of step (c) in a sulfur removal zone to remove said sulfur; and (g) recycling said treated stream of step (f) to said contact with said coal as a portion of said aqueous solution of step (b).

2. The process of claim 1 wherein said grinding conditions include a temperature of from 15° C. to about 90° C.

3. The process of claim 1 wherein said combustion means comprises a furnace with a burner having a burner tip selected for combustion of a coal water admixture.

4. The process of claim 1 wherein said heated stream recycled in step (g) to step (b) is at least partially recycled to said wet-grinding of step (a) as a portion of said presence of water.

5. The process of claim 1 wherein said microorganism present in said treated stream of step (g) recycled to step (b) is treated to regenerate said microorganism.

* * * * *